United States Patent [19]

Farnum

[11] Patent Number: 4,531,316

[45] Date of Patent: Jul. 30, 1985

[54] FRAME FOR PHOTOGRAPHS, VISUAL DISPLAYS, AND THREE-DIMENSIONAL OBJECTS

[76] Inventor: Henry M. Farnum, Executive House, 225 E. 46 St., New York, N.Y. 10017

[21] Appl. No.: 331,965

[22] Filed: Dec. 18, 1981

[51] Int. Cl.[3] ..... G09F 1/10

[52] U.S. Cl. ..... 40/159; 229/71; 40/124.1; 40/158 R

[58] Field of Search ..... 40/152.1, 158 R, 159, 40/124.1, 158; 229/92.8, 71; 283/18, 21

[56] References Cited

U.S. PATENT DOCUMENTS

| | | | |
|---|---|---|---|
| 945,710 | 1/1910 | Doxsee | 40/158 R |
| 1,261,133 | 4/1918 | Kidd | 40/158 R |
| 2,177,405 | 10/1939 | Gross | 40/158 R |
| 2,576,667 | 11/1951 | Bly | 40/158 R |
| 2,935,807 | 5/1960 | Townsend | 40/158 R |
| 3,174,244 | 3/1965 | Walton | 40/158 R |

*Primary Examiner*—John J. Wilson
*Assistant Examiner*—Wenceslao J. Contreras
*Attorney, Agent, or Firm*—Henry M. Farnum

[57] ABSTRACT

An economical frame and protector for photographs, visual displays, and three-dimensional objects, also useable as an envelope for mailing: for the purposes of protecting, framing, and storing the photograph while eliminating the weight of unnecessary wrappers subject to postage; and further providing, integral with the frame a selection of contours for cropping the photograph, slots for instant positioning in a selected orientation in the frame, artistic decorations, upright supporting means, stiffeners, and self-adhering protectors for removing defacing ink-like marks.

20 Claims, 6 Drawing Figures

FRAME FOR PHOTOGRAPHS, VISUAL DISPLAYS, AND THREE-DIMENSIONAL OBJECTS

BACKGROUND OF THIS INVENTION

This invention is directed to the importance of protecting and displaying beautiful photographs, visual displays, and three-dimensional objects. If the cost of protection, framing, and display increases to many times the cost of the beautiful photograph, the object is not protected or displayed.

In the absence of protection and display, the beautiful photograph becomes buried in a pile of ordinary paper. It soon becomes torn, dirty, and lost. The beauty is gone.

Prior art

Throw-aways

First class mail and bulk mailing costs by weight skyrocket from throw-away envelopes in the prior art. The cost is even higher for foreign delivery with high postal rates.

The usual covering envelope is a throw-away—an economic waste. For symmetrical framing, the only way to have a photograph and frame with the same outside dimensions is by low-volume, high-cost, custom-made production quantities, or by excessive, inactive inventories for each incremental change in length and width. Otherwise the photograph is not firmly positioned or symmetrically framed.

Therefore any visual material floats loosely in the envelope, which is not a frame.

It is known in the prior art to mail flat, printed materials with a loose fit in an envelope with a transparent window, or with a cut-out to reveal a portion of the contents which the sender desires to be viewed upon delivery. Such an envelope is a protective wrapper or a bag, and is not a frame for display. Similarly, a picture frame with a rear support must be mailed in a throw-away wrapper, or frame and support get torn.

Furthermore, the mailer inherently is unable to anticipate what display is desired by the recipient. The recipient has no simple way to center the material, to crop the envelope wrapper symmetrically, or to select a desired portion for display.

Ink Defacements of Mailing Envelopes—Throw-aways

Pre-cancelled stamps usually are not available to the individual user. Even if the time-costly effort is made to obtain such stamps, the envelope wrapper usually is disfigured by random, uncontrollable ink markings by the carrier or postal service. If defaced, the envelope wrapper must be used in its defaced condition, or thrown away.

Stiffeners

Non-integral stiffening means are time-intensive to procure and fit.

SUMMARY OF THE INVENTION

In this invention the wasted cost of throw-away protective material is eliminated, and also the user saves the high postage cost for transportation of its unnecessary weight.

In This Invention

Cropping

A flat frame for display flexibly fits photographs of many dimensions. Result: efficient high-volume production, low unit costs, and low inventory costs.

Integral cropping guides for a user enable him to select his exact dimensions desired for the display. The visible portion of the display is cropped easily and symmetrically.

Symmetrical Centering

Integral positioning guides enable easy, symmetrical positioning of the photograph in the frame, to select the general visual area for display.

Delivery Unfolded

An integral, decorative frame travels by mail to arrive in the same flat condition as any large envelope marked "Please do not fold".

Inexpensive Supporting Device

A low-cost, integral supporting device is grooved and perforated by machines for products similar to snap-out forms, at automated speeds.

Ink Marking Removable

A self-adhering, blank, protective label is positioned and designated to receive ink-like markings by the post-office, to protect the decorative frame beneath. The protective label can also record the addresses of sender and addressee.

Stiffener

A stiffener, if needed to reinforce a vertical display, is integral for easy manufacture and mailing.

Three-dimensional Object

For three-dimensional, artistic objects a mailing enclosure with a third dimension of depth displays the enclosed object, with each of the foregoing advantages.

DETAILED DESCRIPTION OF THE PREFERRED EMBODIMENT

Symmetrical Centering

Figure 1A:
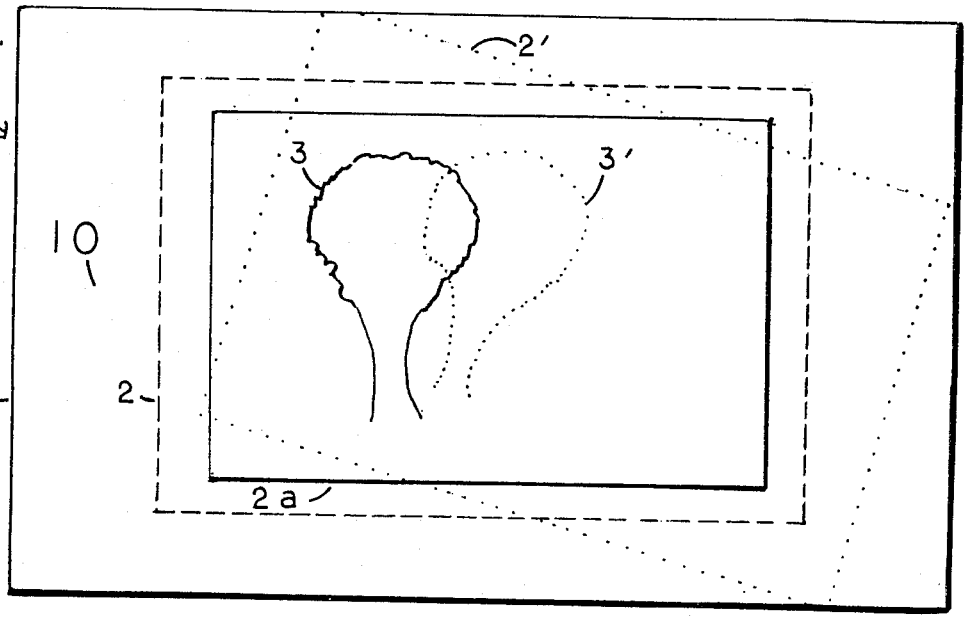
FIG. 1*a* is a vertical view of protective device including framing for a photograph or the like, with integral cropping, protecting, positioning and decorating means.

FIG. 1*a* shows the front panel of protective frame 1. Photograph 2 is instantly centered symmetrically by inserting two or more corners of the photograph in the respective slits of columns 6*a* thru 6*f* in FIG. 2*a*. The slits are partially punched in the manufacture of protective frame 1 by machines automatically performing operations similar to the manufacture of snap-out forms.

Figure 2A:
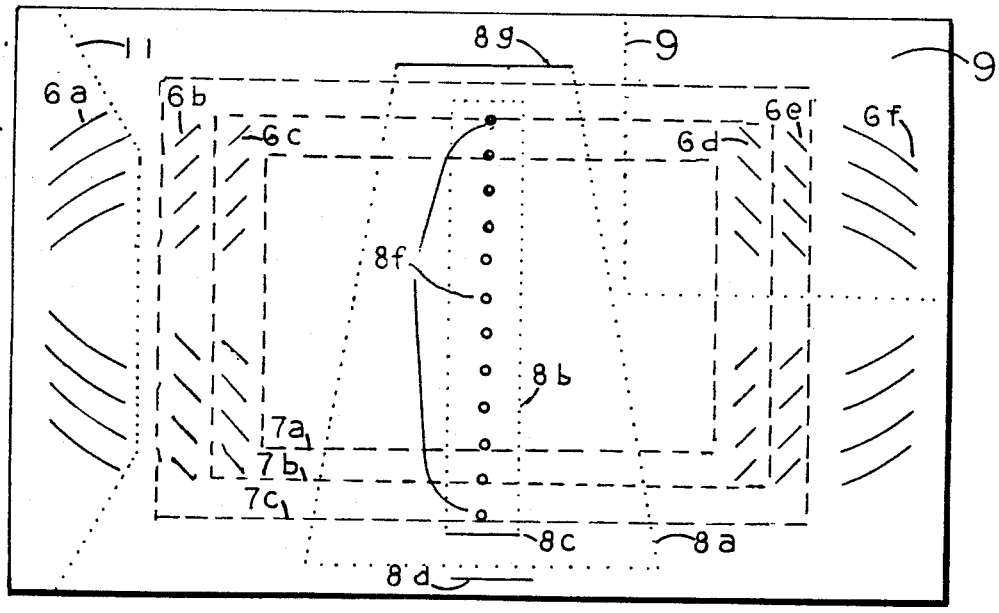
FIG. 2*a* is a rear view of the framing device of FIG. 1, with integral means for positioning the corners of a photo, with a vertical support for a picture frame, and with integral, self-adhering, removable protective materials.

Front and rear portions or panels of frame 1 have been processed by those automatic machines which manufacture frame 1 complete from rolls of paper preferably 0.006" minimum thickness. Operations automatically performed include the following, not necessarily in this order. The rectangular guidemarks shown in lines of dashes in rectangles 7*a*, 7*b* and 7*c* of FIG. 2*a* are printed as cropping guides. In an alternative embodiment, the rectangles could be perforated in the front side of frame 1 in FIG. 1*a*, to enable the user to snap out the selected cropping guide 2*a*.

The supports 8*b* and 8*a* in FIG. 2*a* are partially punched out, as shown by dotted lines in the central area of FIG. 2*a*.

The self-adhesive protective label 9 is cut and affixed as shown in dotted lines in the upper right hand corner of FIG. 2*a*.

Figure 2B:
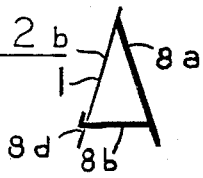
FIG. 2*b* shows the side view of a rear assembly for support.

The front and rear portions of frame 1 are cut to size after all preliminary operations are completed, and assembled as a frame shown in FIGS. 1*a* and 2*b*, including an envelope-type flap 11 shown by dotted lines at the left end of FIG. 2*a*. Flap 11 has self-adhesive for reuse.

In FIG. 1, tree 3' contrasts the prior art with this invention in tree 3 which is symmetrically positioned as aforesaid.

Cropping

The user in positioning photograph 2 has selected the portion of the visual material from which to select the display in frame 1.

The user then selects the desired cropping guide among guides 7*a*, 7*b*, and 7*c* in FIG. 2*a*, showing the rear of frame 1.

The user has many choices including the following as methods to crop the picture.

1. The user can cut cropping frame 2*a* in FIG. 1*a* by using a sharp tool to cut cropping edges 2*a* along the exact guide of one of rectangles 7*a* thru 7*c*.

2. The user can select any line intermediate between guides 7*a* thru 7*c*, being guided by the rectangles 7.

Figure 1B:
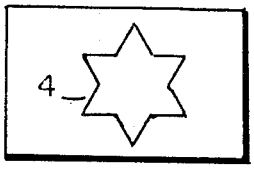
FIG. 1*b* shows a similar enclosure with a six-point star for cropping.

3. In FIG. 1*b*, cropping in the shape of a six-pointed star is shown. Any other design or aesthetic form may be used for decorations 10 and cropping 2*a* in FIG. 1*a*.

Figure 1C:
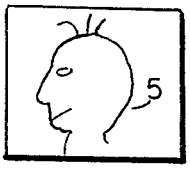
FIG. 1*c* is a side view of a device for visual display with a third dimension of depth, for displaying a three-dimensional object.

In an alternative embodiment, similar control of positioning and cropping can be achieved by three-dimensional character 5 in FIG. 1*c*.

Supporting Stand

The assembly of a supporting stand at the rear of protecting frame 1 is shown in FIG. 2*b*. Vertical support 8*a* is snapped out of the rear side of frame 1 along the dotted lines in the central portion of FIG. 2*a*.

First, horizontal support 8*b* is snapped out of the rear side of frame 1 along its dotted lines in the central part of FIG. 2*a*. Then slot 8*d* is opened.

Then vertical support 8*a* similarly is snapped out. After assembly, supporting strip 8*b* is approximately horizontal, pivoting on its direct connection to upright support 8*a* by its bend in the material at 8*c* comprising a hinge. The free end of strip 8*b* then is inserted into slit 8*d* in frame 1. The friction of embossed protrusions 8*f* upon slot 8*d* are held by friction, and adjusted until frame 1 in FIG. 2*b* is in its desired upright orientation.

Ink Markings Removed

Figure 2C:
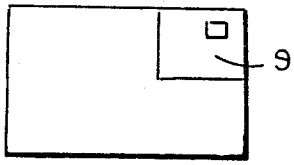
FIG. 2*c* is a reduced view of the self-adhering, protective material.

Self-adhering mailing protector 9 is shown by dotted lines in the upper right hand corner of the rear side of frame 1 in FIG. 2*a*, and shown in reduced size with a postage stamp affixed, in FIG. 2*c*. The purpose of protector 9 is to receive all ink-like markings made by the postoffice or carrier. Then the markings can be removed from frame 1 by removing self-adhesive protector 9. A similar protector can be provided for any portion of the frame if marks are frequently made there by the U.S. Postal Dept.

In an alternative embodiment, said protector can be imprinted with the legend: "Please limit postmarkings, stamp cancellations, and other postal markings in ink, to this area".

Decorating

Area on frame 1 for decoration of its front side is shown in FIG. 1*a*. The decorations can be in color, may include any designs or embellishments, including any contour or shape modifying the cropping line 2*a* in FIG. 1*a*. For example, the decorations can protrude into the visual area of photograph 2, in an artistic manner, such as the contour of leaves.

Stiffener

If integral stiffeners are needed to keep frame 2 upright, an integral stiffener can be provided during manufacture by hinging an additional, second rear portion of frame 1 at the lower edge of the first portion in FIG. 2*a*.

While there have been shown and described only several embodiments of the invention, it will be understood by those skilled in the art that numerous changes and modifications may be made therein without departing from the true spirit and scope of the invention as defined in the appended claims.

Wherefore I claim the following:

1. An improved envelope, said improvement selectively a protecting means for a photograph and similar visual displays, and a display of said photograph in said envelope used as a frame, and comprising:

said envelope with a front panel and a rear panel;

a cropping guide for cropping said display thru a cropped area in said front panel, said cropped area selected in relation to said cropping guide and removed from said front panel;

said cropped area, when uncropped, protecting said envelope from tearing or damage during any mailing, protecting, and storage of said photograph; and framing said photograph after said removal of said cropped area; and said front panel and said rear panel; or said front panel, said rear panel, and a separate sheet with said cropping guide; cooperating to provide a stiffness suitable for rigidity in said frame for said display;

for constructing said frame for said display of said photograph from said envelope without additional cost for manufacture and for weight in mailing said frame;

for cropping said envelope in relation to said cropping guide for use as said frame;

for display to an observer of said photograph in said frame; and for selectively mailing, displaying, protecting, and storing said photograph in said envelope.

2. The apparatus of claim 1, wherein said protecting means includes at least one said cropping guide.

3. The apparatus of claim 2 further including integral positioning means for positioning the photograph in a selected orientation in relation to said frame.

4. The apparatus of claim 2 further comprising integral decorating means, for artistically framing the photograph.

5. The apparatus of claim 2 further comprising integral supporting means, for supporting said frame in a selected orientation for viewing by an observer.

6. The apparatus of claim 2 further comprising integral, self-adhering means, for selectively receiving ink-like markings and removing them from the display.

7. The apparatus of claim 2 further comprising integral stiffening means, for increasing the erect stability of the photograph in the frame.

8. The apparatus of claim 1 wherein said photograph and similar visual display includes a three-dimensional object, and said protecting means includes a dimension of depth sufficient to enclose said three-dimensional object.

9. The apparatus of claim 1, wherein said protecting means includes a front portion with cropping guides scored on the rear side of said front portion, said scoring with a depth to enable a user to snap out a selected cropped area for said display, and with the unscored depth of said cropping guide sufficient for strength of said protecting means for protection during mailing, and for leaving a smooth, exterior surface of said protecting means to prevent tearing during said mailing;

said cropping guides for cropping said protecting means for use as a frame for said photograph without cropping guides imprinted on said front portion for display, for display of said photograph in said frame without visible cropping guides in said display, and for removing said selected cropped area by snapping out said area without the use of cutting means or the like.

10. The apparatus of claim 1, wherein said cropping guides are printed on a sheet inserted into said protecting means and visible to said user viewing thru said front panel, for said cropping of said protecting means for use as a frame for said photograph without cropping guides imprinted on said front panel, and for said display of said photograph in said frame without visible cropping guides in said display.

11. An improved protecting means for a photograph and similar visual displays, wherein said improvement comprises a protecting means which frames said display, for selectively mailing, displaying, protecting and storing said photograph, and for displaying said photograph in a clean frame or with undefaced decoration and the like, and comprising:

integral, self-adhering means, for receiving defacing marks by a carrier and the like, including cancellation of postage, postmarks, and the like, when said enclosing means is in transit, and wherein further said adhesive material with said markings is removed upon receipt by a user;

for enabling said user to remove defacing marks caused by uncontrollable events such as stamp cancellations, postmarks, automatic mail sorters, and the like; and for displaying said photograph in said clean frame, or in said frame with undefaced decorations, and the like.

12. The apparatus of claim 2, wherein said rear and front panels each has a preferred minimum thickness of 0.006 inch.

13. The apparatus of claim 2, including integral supporting means, for supporting said frame in a selected orientation, said orientation including an upright position for said display on a vertical surface, for viewing by an observer.

14. The apparatus of claim 2, including:

an integral, self-adhering means, said self-adhering means receiving ink-like markings by a postoffice, carrier, and the like; said markings including cancellation of postage, postmarks, and the like; when said envelope is in transit; and wherein further said self-adhering material with said markings is removed upon receipt by a user;

for enabling said user to remove defacing marks caused by uncontrollable events such as said stamp cancellations by automatic mail sorters; and for displaying said photograph in said frame without said defacing marks and the like.

15. The apparatus of claim 2, wherein said cropping guide is substantially unnoticable by an observer of said display, and slightly visible to a user.

16. The apparatus of claim 2, including said photograph imprinted in a selected orientation on the front side of said rear panel.

17. The apparatus of claim 1, wherein said cropping guide is located on said rear or front panel and is slightly visible to said user by a transmitted light thru, or reflected light upon said front panel, for cropping said front panel of said envelope for use as said frame; and with said cropping guide substantially unnoticable by said reflected light to said observer of said display;

said cropping guide including a plurality of dots, lines, marks, or pinholes on said rear panel, or on a rear, interior side of said front panel, or including embossed depressions on a front, exterior side of said front panel;

said cropping guide to guide the removal of said cropped area of said front panel for use as said frame for said photograph;

for providing a substantially smooth, unbroken exterior of said envelope for said mailing;

for providing said display of a selected portion of said photograph thru said cropped area, said photograph completely covering any cropping guide directly therebehind; and for covering, by the thickness of said front panel, any portion of said cropping guide behind and extending beyond said photograph, from said observer of said display.

18. The apparatus of claim 1, wherein said cropping guide includes:

grooves partially punched, impressed or cut to a selected depth in a rear interior side of said front panel;

for providing a substantially smooth, exterior surface of said envelope to prevent tearing during mailing; and for snapping-out said cropped area for use of said envelope as said frame for said photograph.

19. The apparatus of claim 1, wherein:

said cropping guide is recorded on a sheet separate from said rear and said front panel, with said sheet inserted into said envelope with said cropping guide slightly visible thru said front panel;

said cropping guide including a plurality of lines, dots, marks, or pinholes, on a selected side of said separate sheet;

said front and rear panels of said envelope, combined with said separate sheet, preferably having a combined minimum thickness of 0.012 inch;

for cropping said envelope in relation to said cropping guide for use as said frame; and for providing said stiffness suitable for said rigidity in said frame.

20. The apparatus of claim 1, wherein said semi-opaque front panel has a preferred minimum thickness of 0.006", for transmitting a slightly visible image of said cropping guide by a transmitted light thru, or a reflected light upon said front panel, with said light of normal intensity; and said front panel with a preferred maximum thickness which transmits said slightly visible image of said cropping guide by means of said light of normal intensity, for cropping said front panel for use as said frame; and wherein further said cropping guide is substantially unnoticable by said light of normal intensity, to an observer of said display.

* * * * *